US007392755B2

(12) United States Patent
Kato et al.

(10) Patent No.: US 7,392,755 B2
(45) Date of Patent: Jul. 1, 2008

(54) SEWING MACHINE CAPABLE OF EMBROIDERY SEWING

(75) Inventors: Haruna Kato, Tsushima (JP); Naoki Igushi, Nagoya (JP); Masayuki Iwata, Gifu (JP); Shinichi Nishida, Nagoya (JP); Eiichi Ito, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/725,436

(22) Filed: Mar. 20, 2007

(65) Prior Publication Data

US 2007/0221107 A1 Sep. 27, 2007

(30) Foreign Application Priority Data

Mar. 23, 2006 (JP) ..... 2006-080941

(51) Int. Cl.
*D05B 21/00* (2006.01)

(52) U.S. Cl. ..... 112/102.5; 112/103; 112/470.06

(58) Field of Classification Search ..... 112/102.5, 112/103, 470.01, 470.06, 475.02; 700/136, 700/138

See application file for complete search history.

(56) References Cited

U.S. PATENT DOCUMENTS 4,763,586 A * 8/1988 Takenoya et al. ..... 112/103
4,834,008 A * 5/1989 Sadeh et al. ..... 112/470.07
4,849,902 A * 7/1989 Yokoe et al. ..... 112/102.5
4,860,675 A * 8/1989 Brower et al. ..... 112/470.06
4,932,343 A * 6/1990 Mardix et al. ..... 112/470.07
4,998,489 A 3/1991 Hisatake et al.
5,195,451 A * 3/1993 Nakashima ..... 112/102.5
5,323,722 A * 6/1994 Goto et al. ..... 112/102.5
5,537,946 A * 7/1996 Sadeh et al. ..... 112/475.03
5,757,674 A 5/1998 Marugame
5,911,182 A * 6/1999 Uyama et al. ..... 112/102.5
6,161,491 A * 12/2000 Takenoya et al. ..... 112/102.5
6,298,799 B1 * 10/2001 Hirose ..... 112/102.5
6,470,813 B2 * 10/2002 Ebata et al. ..... 112/102.5
6,568,337 B1 * 5/2003 Durville ..... 112/102.5
6,578,503 B2 * 6/2003 Matsuzawa et al. ..... 112/102.5
6,728,417 B1 4/2004 Hara et al.
6,820,565 B1 * 11/2004 Kawaguchi et al. ..... 112/102.5
6,959,657 B1 * 11/2005 Duval ..... 112/475.02
7,155,302 B2 * 12/2006 Muto et al. ..... 700/138
7,258,071 B2 * 8/2007 Shoji ..... 112/103
2003/0131773 A1 * 7/2003 Schweizer ..... 112/102.5
2004/0221780 A1 * 11/2004 Kawaguchi et al. ..... 112/102.5

(Continued)

FOREIGN PATENT DOCUMENTS

JP A 02-057288 2/1990

(Continued)

*Primary Examiner*—Gary L. Welch
*Assistant Examiner*—Nathan E Durham
(74) *Attorney, Agent, or Firm*—Oliff & Berridge, PLC

(57) ABSTRACT

A sewing machine capable of embroidery sewing is configured to specify a type of embroidery frame by shooting an embroidery frame placed on an upper surface of the bed by a CCD or a CMOS image sensor disposed in an underside of an arm from an obliquely upward direction and obtaining an X-directional size and a Y-directional size of the embroidery frame, an embroiderable area size, and further a height-directional size of the embroidery frame by calculation based on image data shot by the image sensor.

6 Claims, 7 Drawing Sheets

U.S. PATENT DOCUMENTS

| | | | | |
|---|---|---|---|---|
| 2005/0016428 | A1* | 1/2005 | Koerner | 112/117 |
| 2005/0234585 | A1* | 10/2005 | Muto et al. | 700/138 |
| 2006/0213415 | A1* | 9/2006 | Konig et al. | 112/475.01 |

FOREIGN PATENT DOCUMENTS

| | | |
|---|---|---|
| JP | A 04-254704 | 9/1992 |
| JP | A 04-256772 | 9/1992 |
| JP | B2 2649540 | 5/1997 |
| JP | A 09-231373 | 9/1997 |
| JP | A 2000-241120 | 9/2000 |
| JP | A 2002-052283 | 2/2002 |

* cited by examiner

EMBROIDERY FRAME INFORMATION MEMORY

| OUTLINE DATA | EMBROIDERABLE AREA SIZE | X-DIRECTIONAL SIZE | Y-DIRECTIONAL SIZE | HEIGHT-DIRECTIONAL SIZE |
|---|---|---|---|---|
| ・・・・・・・・・・ | 13.2cm×18.3cm | 15.5cm | 21.5cm | 10mm |
| ・・・・・・・・・・ | 11.3cm×19.2cm | 14.6cm | 22.8cm | 8mm |
| ・・・・・・・・・・ | 14.5cm×19.1cm | 16.8cm | 23.7cm | 11mm |
| ・・・・・・・・・・ | 14.4cm×22.5cm | 16.2cm | 24.5cm | 10mm |
| | | | | |

FIG.3

SEWING MACHINE CAPABLE OF EMBROIDERY SEWING

This application is based upon and claims the benefit of priority from the prior Japanese Patent Application 2006-080941, filed on, Mar. 23, 2006 the entire contents of which are incorporated herein by reference.

FIELD

The present disclosure is directed to a sewing machine capable of embroidery sewing which identifies the type of embroidery frame attachably/detachably attached to the carriage provided in the embroidery frame drive unit based on image data shot by an imaging unit.

BACKGROUND

Conventionally, sewing machines executing embroidery sewing with attachable/detachable attachment of an embroidery frame drive unit thereto sews embroidery on a workpiece cloth based on sewing data for a pre-selected embroidery pattern by attaching an embroidery frame holding a workpiece cloth to be sewn on a carriage of the embroidery frame drive unit and moving the embroidery frame in the X-direction and the Y-direction. Thus, such sewing machines are provided with plurality types of embroidery frames such as rectangular, circular, and oval shapes varying in size and shape of the embroidery pattern for use in sewing embroidery.

Such being the case, sewing machines capable of embroidery sewing detect the type of embroidery frame attached to the carriage in order to check whether or not an embroidery frame having smaller embroidery area compared to the size of the intended embroidery pattern has been attached by mistake.

For example, the embroidery frame carrier unit disclosed in patent document 1 (JP 2002-52283 A page 5 to 7, FIGS. 10 and 14) is configured so that three detection switches are disposed in the carriage of the frame carrier unit in a single longitudinal row, while three switch activators corresponding to the three detection switches are provided in a connection portion of the embroidery frame so as to be associated with the three detection switches. When the connecting portion of the embroidery frame is slid into attachment with the carriage by sliding the embroidery frame from the front to the rear direction, the type of embroidery frame attached to the carriage is detected based on whether each of the three detection switches are activated or not depending upon the presence/absence of the switch activators.

Since the embroidery frame carrier unit described in patent document 1 is merely provided with three detection switches in the carriage, the combinations of ON signals and OFF signals delivered from the three detection switches only allow detection of maximum of eight types of embroidery frames. Moreover, dedicated switch activators for each type of embroidery frame must be disposed to each embroidery frame, thus disallowing the use of embroidery frames without switch activators. Furthermore, in addition to disposing plurality of detection switches to the carriage, and increased complexity in wiring interconnects for signal transmission that connect to each detection switches to the movable carriage, input ports for a CPU constituting a control unit need to be prepared as many as the number of detection switches, thereby leading to problems such as cost increase in the control unit.

SUMMARY

An object of the present disclosure is to provide a sewing machine capable of embroidery sewing that allows easy and quick identification of increased variations of embroidery frame types without having to make any modifications to the embroidery frame.

A sewing machine capable of embroidery sewing of the present disclosure includes a carriage connected attachably/detachably to an embroidery frame holding a workpiece cloth; an embroidery frame drive mechanism that drives the carriage independently in an X-direction and a Y-direction perpendicular to each other respectively; an imaging unit that shoots the embroidery frame and that outputs image data thereof; and a calculating unit that calculates at least an X-directional size and a Y-directional size of the embroidery frame based on the image data of the embroidery frame.

When the embroidery frame holding the workpiece cloth is shot by the imaging unit when in attachment with the carriage, at least the X- and Y-directional sizes of the embroidery frame are calculated based on the image data shot by the imaging unit. As a result, the type of embroidery frame is specified by the calculated X- and Y-directional sizes. That is, the type of embroidery frame can be specified easily and quickly by calculating at least the X- and Y-directional sizes of the embroidery frame based on the image data obtained by shooting the embroidery frame. Thus, there is no need for any modification whatsoever such as providing the embroidery frame with switch activators, thereby allowing low cost manufacturing of the embroidery frame and moreover, eliminating the need for mounting and wiring electrical parts such as detection switches.

BRIEF DESCRIPTION OF THE DRAWINGS

Other objects, features and advantages of the present disclosure will become clear upon reviewing the following description of the illustrative aspects with reference to the accompanying drawings, in which.

FIG. 3 is a chart describing an embroidery frame information memory content;

DETAILED DESCRIPTION

Figure 1:
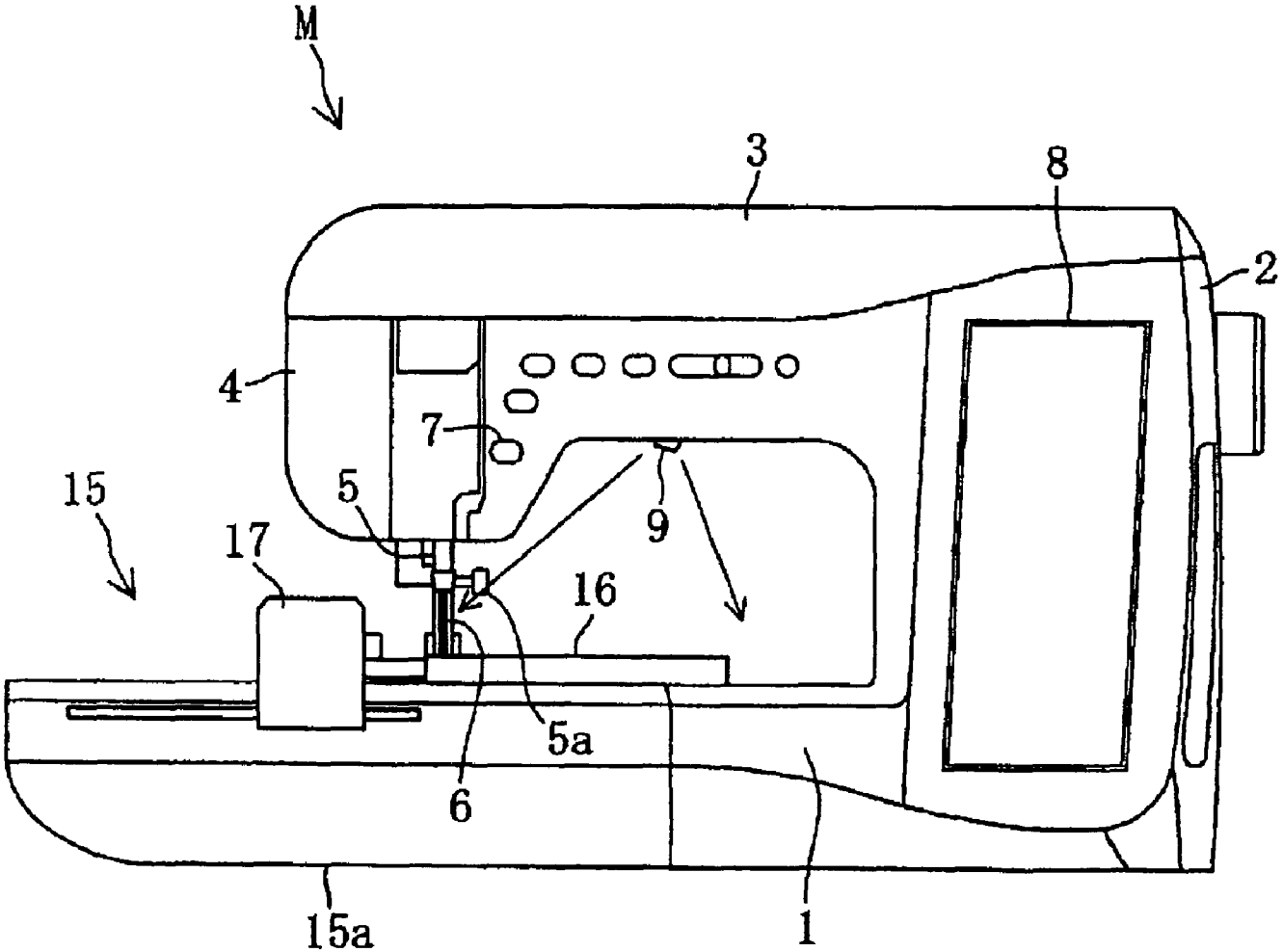
FIG. 1 illustrates a sewing machine capable of embroidery sewing in accordance with an illustrative aspect of the present disclosure showing a front view of the sewing machine in its entirety.

One embodiment of the present disclosure will be described with reference to the drawings. In a sewing machine M capable of embroidery sewing, embroidery pattern sewing is enabled upon attachment of a later described embroidery frame drive mechanism 15. As shown in FIG. 1, the sewing machine M includes a bed 1, a pillar 2 standing on the right end of the bed 1, and an arm 3 extending leftward from the upper end of the pillar 2 so as to confront the bed 1.

The bed 1 includes a feed dog vertically moving mechanism (not shown) that vertically moves a feed dog (not shown); a feed dog longitudinally moving mechanism (not shown) that longitudinally moves the feed dog; a loop-taker (a horizontal rotary shuttle for example) not shown that contain a bobbin and operating in cooperation with the sewing needle 6.

The head 4 of the arm 3 includes a needle bar drive mechanism (not shown) that vertically moves the needle bar 5; a needle bar swing mechanism (not shown) that swings the needle bar 5 in a direction perpendicular to a cloth feed direction; a presser bar (not shown) having a presser foot (not shown) attached to the lower end thereof that press the workpiece cloth; and a thread take-up drive mechanism (not shown) for vertically moving a thread take-up not shown in synchronization with the vertical movement of the needle bar 5. The sewing needle 6 is secured to the needle bar 5 by a needle clamp 5*a* provided in the lower end of the needle bar 5. The feed dog vertically moving mechanism, the needle bar drive mechanism, and the thread take-up drive mechanism are driven respectively by a sewing machine motor 26 and the needle bar swing mechanism is driven by a needle swing motor 27. A sewing switch 7 is provided in the head 4 of the arm 3 for instructing start and stop of a sewing operation by manual operation.

A color liquid crystal display 8 is provided in the front face of the pillar 2 and the liquid crystal display 8 displays various stitch patterns such as utility patterns and embroidery patterns, various function names, pattern names and messages. Though details will not be given, touch keys (not shown) composed of transparent electrodes are provided in the front face of the liquid crystal display 8, and the sewer is allowed to select patterns to be sewn and functions to be executed by operating the touch keys as required.

A free bed also known as the free arm, is formed in the left end portion of the bed 1, and the embroidery frame drive mechanism 15 (that is, the embroidery unit) is attachably/detachably attached to the free bed. The embroidery frame drive mechanism 15 includes a body frame 15*a*; an embroidery frame 16 to which a workpiece cloth is attachably/detachably attached; a Y-direction drive portion 17 housing a Y-direction drive mechanism that drives the embroidery frame 16 in the Y-direction (longitudinal direction); and an X-direction drive mechanism contained in the body frame 15*a* and driving a Y-direction drive portion 17 in the X-direction (lateral direction).

A carriage (not shown) is provided in the Y-direction drive portion 17 and the embroidery frame 16 is attachably/detachably attached to the carriage (not shown) via the connecting portion (not shown) thereof. The X-direction drive mechanism moves the Y-direction drive portion 17 including the carriage in the X-direction by driving an X-direction motor 11, and the Y-direction drive mechanism moves the carriage in the Y-direction by driving a Y-direction motor 12.

When the embroidery frame drive mechanism 15 is attached to the free bed, the X- and Y-direction motors 11 and 12 are electrically connected to a control unit 20 of the sewing machine M via the connector 28. When the embroidery frame 16 is connected to the carriage, the X- and Y-direction motors 11 and 12 are respectively controlled by the control unit 20 and the embroidery frame 16 having a workpiece cloth W set thereto is moved independently in the X- and Y-directions, thereby forming embroidery patterns on the workpiece cloth W.

As shown in FIG. 1, an image sensor 9 is disposed in the underside of the arm 3 so as to shoot the embroidery frame 16 placed on the upper surface of the bed 1 from the obliquely upward direction. The image sensor 9 is composed of CCD (charge coupled device) or CMOS imaging elements. Thus, when the embroidery frame 16 connected to the carriage is moved to the maximum extent (a shooting position shown in FIG. 1) in the X-direction to the pillar 2 side, the embroidery frame 16 in its entirety is shot by the image sensor 9.

Figure 2:
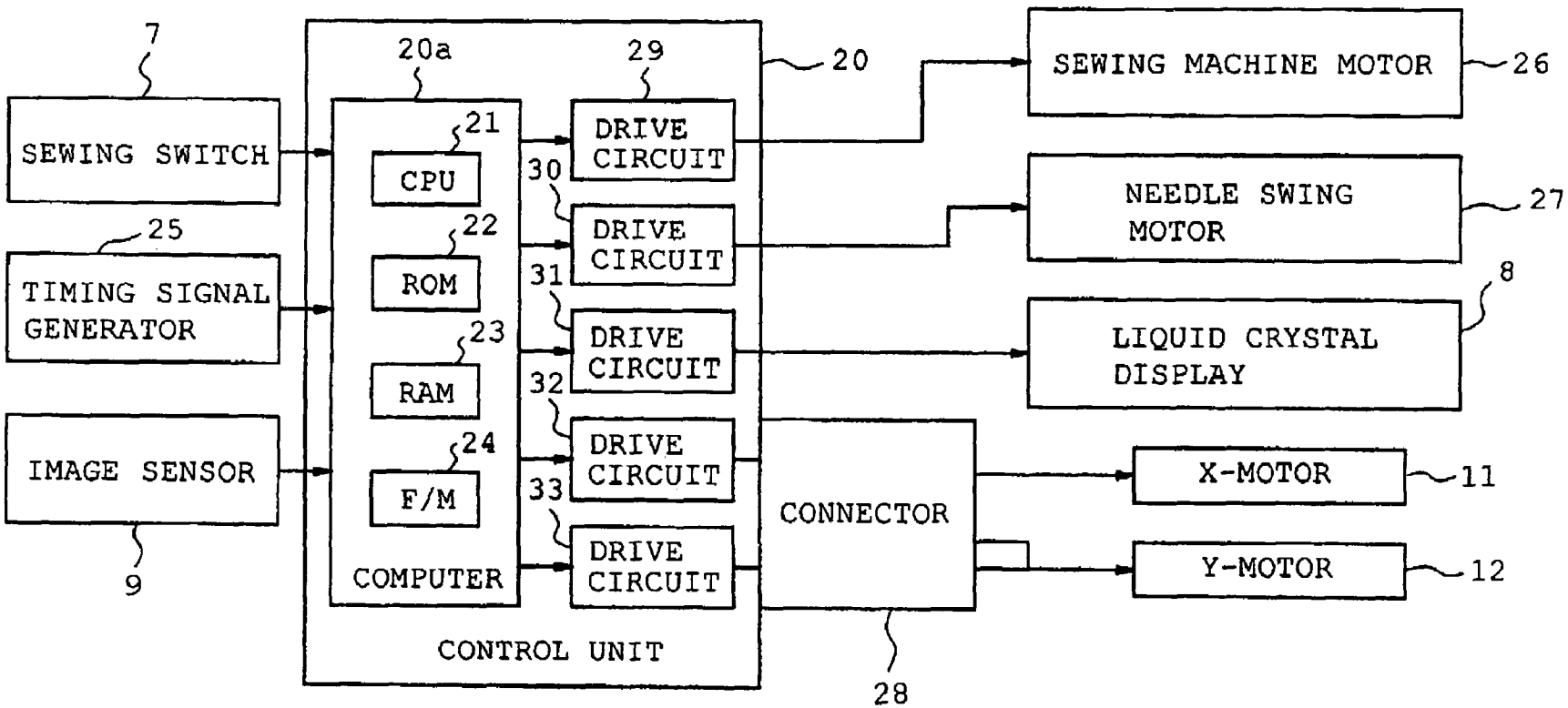
FIG. 2 is a block diagram of a control system of the sewing machine.

Next, a control system of the sewing machine M will be described hereinafter. As shown in FIG. 2, the control unit 20 includes a computer 20*a* including a CPU 21, a ROM 22, a RAM 23 and an electrically programmable non-volatile flash memory (F/M) 24, and an a plurality of drive circuits 29 to 33.

The computer 20*a* has connected thereto via a connector 28, a sewing switch 7; a timing signal generator 25 that detects rotary phase of the sewing machine main shaft; an image sensor 9; a drive circuit 29 for a sewing machine motor 26; a drive circuit 30 for a needle swing motor 27, a display drive circuit 31 for a liquid crystal display 8; and drive circuits 32 and 33 for X-direction motor 11 and Y-direction motor 12 respectively that constitute the embroidery frame drive mechanism 15.

The ROM 22 has preinstalled therein a sewing control program for sewing utility patterns and embroidery patterns; general control programs for display control; and a later described embroidery frame identification control program that constitute the feature of the present disclosure. Areas for providing flags, pointers, counters, registers, and buffers, and the like, are secured in the RAM 23 as required in executing various controls.

When the embroidery frame 16 connected to the carriage is shot from the obliquely upward direction by the image sensor 9, as shown in FIG. 3, embroidery frame information data mapping the innermost outline data of the transparent projected image data, the embroiderable area size, the X and Y-directional sizes of the embroidery frame 16, and height-directional size of the embroidery frame 16 are stored in the flash memory 24. FIG. 3 shows embroidery frame information pertaining to four types of embroidery frames 16 being stored respectively in the flash memory 24.

Figure 4:
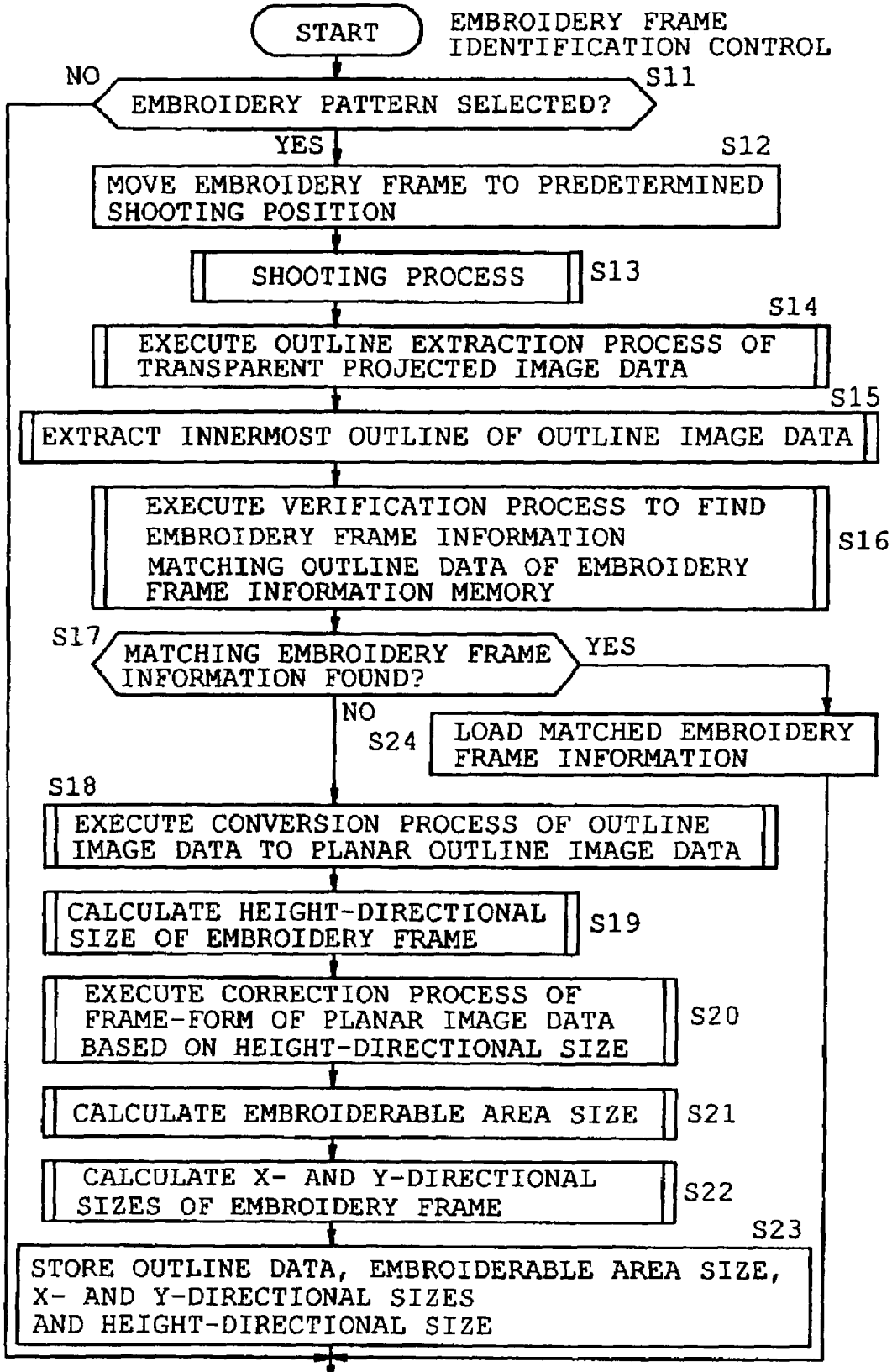
FIG. 4 is a flowchart of an embroidery frame identification control.

Next, the embroidery frame identification control executed by the control unit 20 of the sewing machine M is described with reference to FIGS. 5 to 8 based on the flowchart in FIG. 4. Symbols Si (i=11, 12, 13 . . . ) indicate each step.

This control is started when power is supplied to the sewing machine M. First, after the user attaches the embroidery frame 16 having the workpiece cloth set thereto to the carriage, when a given embroidery pattern is selected from a normal pattern group and an embroidery pattern group displayed to the liquid crystal display 8, the embroidery sewing mode is set (S11:Yes).

Figure 5:
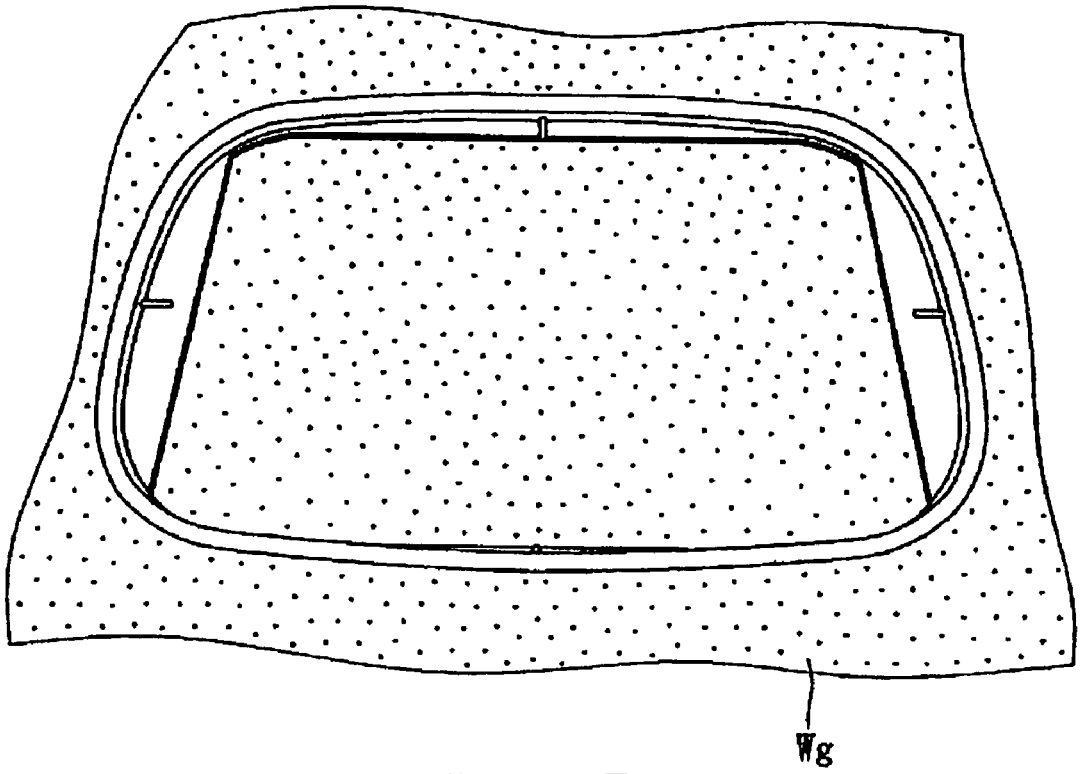
FIG. 5 illustrates image data obtained.

Then, the embroidery frame 16 is moved to the predetermined shooting position, for example, the aforementioned shooting position where the embroidery frame 16 is moved to the shooting position moved furthest to the pillar 2 side (S12) shown in FIG. 1, and is shot by the image sensor 9 (S13). When the embroidery frame 16 is moved to the above shooting position, the entire embroidery frame 16 is shot at one go. It is to be noted that, the shot image data of the shot embroidery frame 16 is a transparent projected image data as indicated in FIG. 5. Also, the reference symbol Wg indicates an image of the workpiece cloth.

Figure 6:
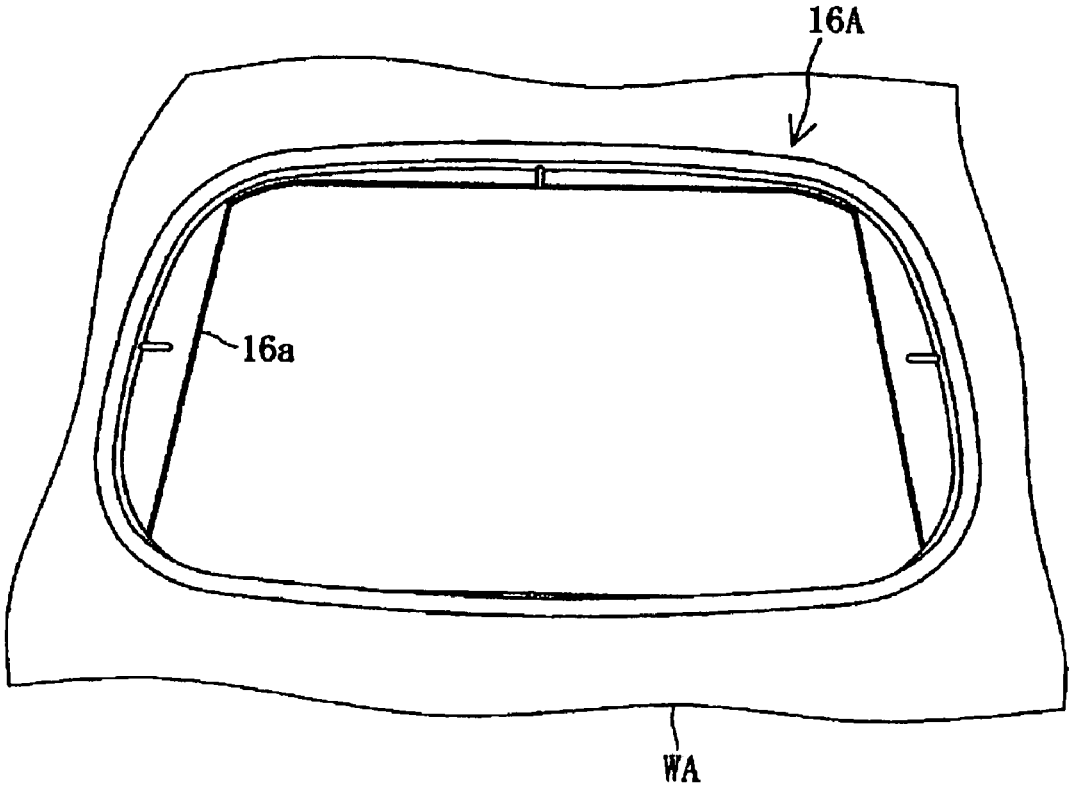
FIG. 6 illustrates calculated outlines of an embroidery frame.

Next, based on the transparent projected image data obtained in the described manner, an outline extraction process is executed (S14) to obtain the outline 16A and WA as shown in FIG. 6. As well known, in the outline extraction process, first, the shot image data is binarized by a "threshold value" that enable identification of the embroidery frame 16; and thereafter a noise canceling process, and the like, is executed. Finally, an outline extraction process for obtaining image data composed of the outline 16A of the embroidery frame 16 and the outline WA of the workpiece cloth is executed to identify the shape of the embroidery frame 16.

Figure 7:
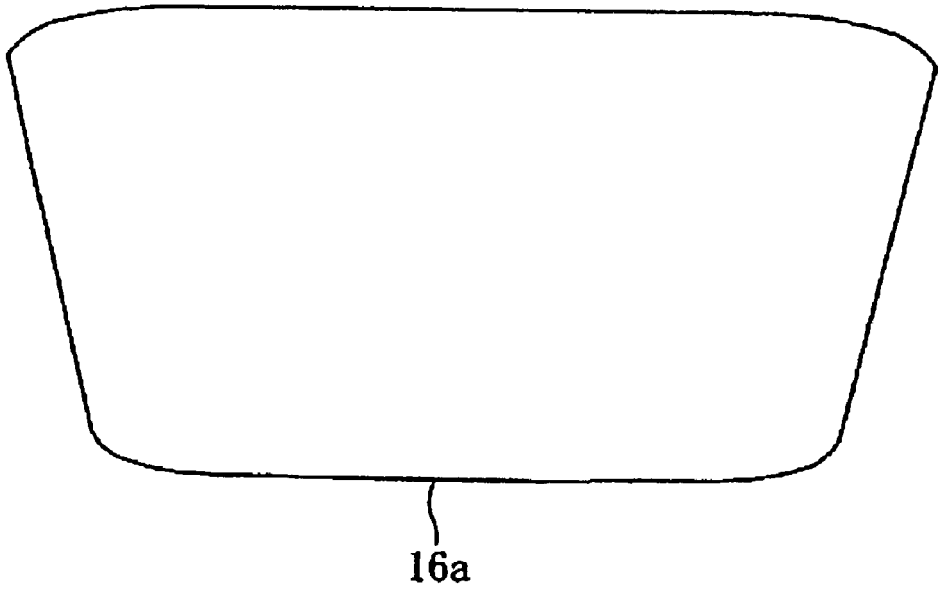
FIG. 7 illustrates a calculated innermost outline of the embroidery frame.

Subsequently, as shown in FIG. 7, only the innermost outline 16*a* of the embroidery frame 16 is extracted from the outline image data obtained from the described manner (S15). Next, a verification process is executed to determine whether embroidery frame information matching the outline data contained in the embroidery frame information already stored in the flash memory 24 exists or not (S16). As a result of the verification process, if matching embroidery frame information is found (S17: Yes), the matching embroidery frame information is loaded (S24) and the process is terminated.

Figure 8:
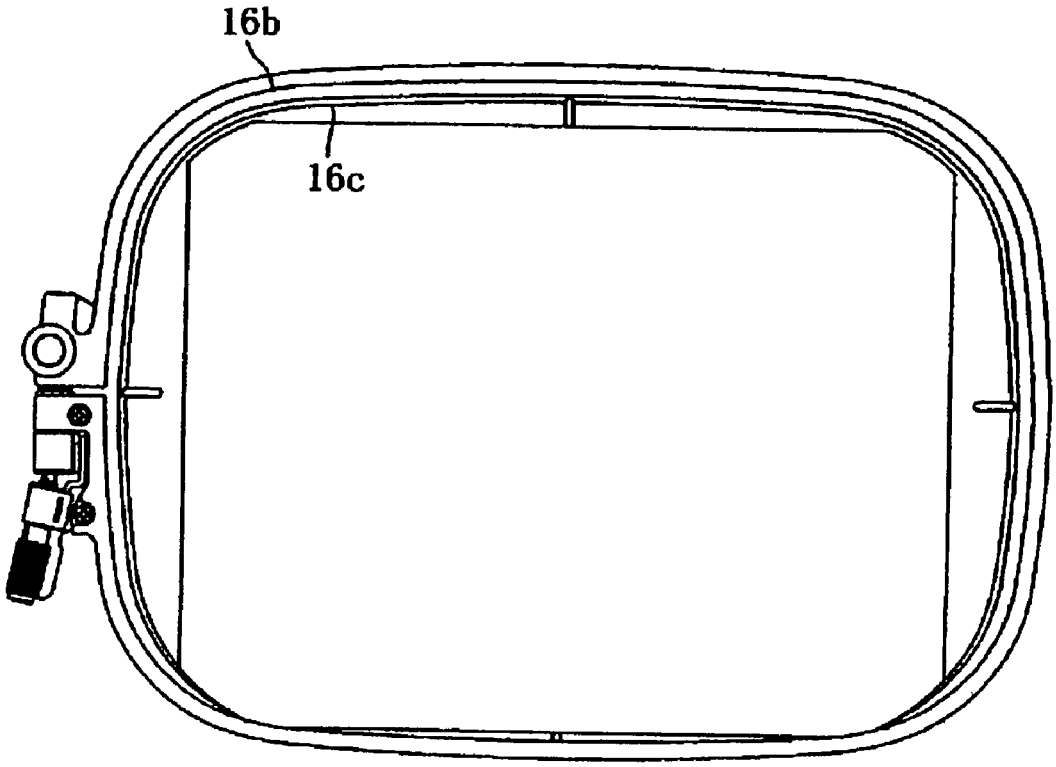
FIG. 8 illustrates a calculated planar outline.

However, as a result of the verification process, if matching embroidery frame information is not found (S17: No), the transparent projected image data is converted to a planar outline image data (S18) based on the outline image data obtained by the outline extraction process of 514. In this case, since shooting distance from the position where the image sensor 9 is mounted to the carriage located in the shooting position is maintained at a consistent distance, the outline image data obtained in S14 can be converted to a planar outline image data by applying a predetermined correction coefficient thereto. As a result, a substantially planar outline image data can be obtained as shown in FIG. 8 for example.

Next, the height-directional size of the embroidery frame 16 is calculated based on the outlines (outlines in the upper side in FIG. 8) in the distant side of the image sensor 9 among the substantially planar outline image data obtained in S18. More specifically, the height-directional size of the embroidery frame 16 is calculated based on the distance between an outline 16*b* indicative of the highest point of the embroidery frame 16 which is the second outline counting from the outer side and an outline 16*c* indicative of a lowest point of the embroidery frame 16 which is the fourth outline counting from the outer side, and the aforementioned shooting distance (S19).

Figure 9:
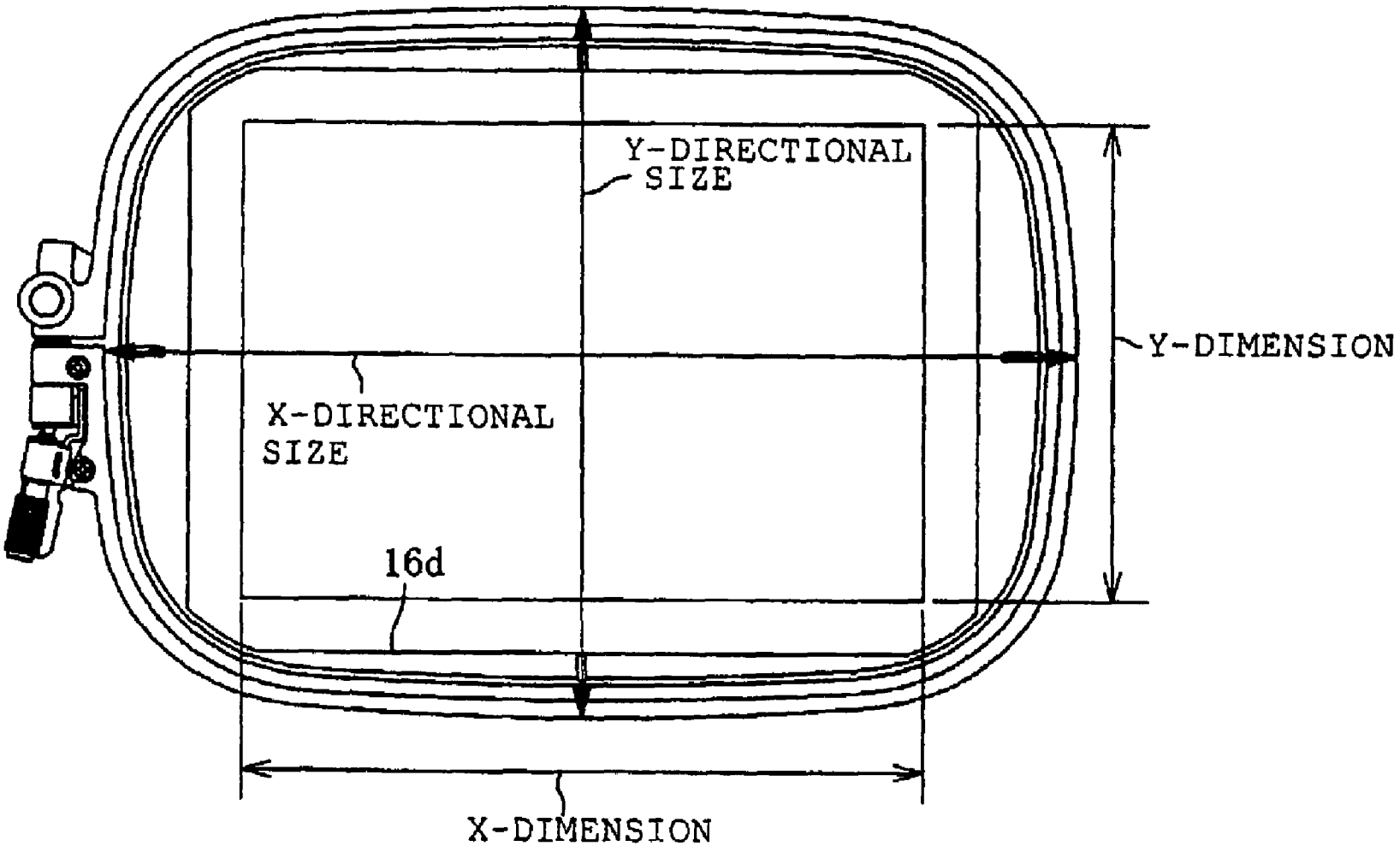
FIG. 9 illustrates an outline of an embroidery frame with corrected height.

Next, based on the height-directional size of the embroidery frame 16 thus obtained, as shown in FIG. 9, the outlines of the embroidery frame 16 in the distant side relative to the image sensor 9 and the outlines in the closer side relative to the image sensor 9 are corrected respectively so as to ignore the height of the embroidery frame 16 (S20). That is, a correction is made to create planar image data of the embroidery frame 16 that would appear as an image of the entire embroidery frame shot from above.

Next, based on the planar outline image data thus corrected, as shown in FIG. 9, the distance between the mutually opposing innermost outlines (inter-outline distance) is calculated based on the innermost outline 16*d*. Further, an embroiderable area size (X-dimension and Y-dimension) which is shorter by a predetermined distance from the inter-outline distance is calculated in order to avoid collision with the presser foot and the needle bar clamp 5*a* (S21). Next, based on the planar outline image data thus corrected, as shown in FIG. 9, the X-directional size and the Y-directional size which constitute the outlining dimension of the embroidery frame 16 are calculated respectively (S22).

Next, transparent projected outline image data calculated in S15 and data of embroidery frame information including the embroiderable area size, the X- and Y-directional sizes and the height-directional size is stored in the flash memory 24 (S23) and the process is terminated. However, when this control is started, in case a given normal pattern is selected from a group of normal patterns displayed on the liquid crystal display 8 (S11: No) instead of an embroidery pattern, the process is terminated immediately.

As described above, the sewing machine M includes a carriage to which an embroidery frame 16 holding a workpiece cloth W is connected attachably/detachably; an embroidery frame drive mechanism 15 that drives the carriage independently in the X-and Y-directions perpendicular to the other; an image sensor 9; and an embroidery frame identification control program. Thus, by merely shooting the embroidery frame 16 with the image sensor 9, at least the X- and Y-directional sizes of the embroidery frame 16 can be calculated from the image data outputted from the image sensor 9 and the type of embroidery frame 16 can be readily and quickly be identified based on the X- and Y-directional sizes.

Thus, since no modification such as providing the embroidery frame 16 with a switch activator is required, the embroidery frame 16 can be manufactured with low cost and the embroidery frame drive mechanism 15 can do without provision of electric components such as detection switches and wiring.

Also, since the image sensor 9 employs a CCD image sensor or a CMOS image sensor, high-quality image data can be readily captured by a low-cost configuration by these compact image sensors 9. Also, these compact image sensors 9 may be readily placed in the underside of the arm 3 free from interrupting the sewing operation and free from interfering with other parts.

Also, the image sensor 9 is disposed in the underside of the arm 3 so as to shoot the embroidery frame 16 placed on the upper surface of the bed 1 from the obliquely upward direction and the image data outputted from the image sensor 9 is converted to planar image data. Since the X- and Y-directional sizes are calculated based on the converted image data, the transparent projected image data outputted from the image sensor 9 can be readily converted to planar image data and consequently obtain the X- and Y-directional sizes with high accuracy.

Also, in the embroidery frame identification control in S19, since the height-directional size of the embroidery frame 16 is calculated based on the image data outputted from the image sensor 9, outlines in the inner lower portion of the image sensor 9 side of the embroidery frame 16 which cannot be shot from the obliquely upward direction can be calculated based on the height-directional size, thereby allowing accurate calculation of planar image data. Also, when the embroidery frame 16 is moved during a sewing operation, an accurate judgment is made as to whether the embroidery frame 16 will collide with the presser foot or not, thereby allowing reliable prevention of such collision. Furthermore, when the embroidery frame 16 is moved leftward in close proximity of the needle bar 5, an accurate judgment is made as to whether the needle clamp 5*a* will collide with the embroidery frame 16 or not as well, thereby allowing reliable prevention of such collision.

Also, in S21 of the embroidery frame identification control, since the embroiderable area size of the embroidery frame 16 is calculated based on the image data, an accurate judgment can be made as to whether the embroidery frame 16 attached to the carriage is suitable for the size of embroidery pattern to be sewn.

Also, since the image data outputted from the image sensor 9 and the embroidery frame information including the calculated X- and Y-directional sizes, the height-directional size, and the embroiderable area size of the embroidery frame 16 are stored in the flash memory 24, embroidery frame information pertaining to the embroidery frame 16 once used by being attached to the carriage is stored in the flash memory 24. Thus, when using the same embroidery frame 16 from the second time onwards, not only the type of embroidery frame 16 but also the embroidery frame information thereof can be quickly and readily obtained by merely obtaining image data by shots taken by the image sensor 9.

Further, in S16 and S17 of the embroidery frame identification control, verification is made as to whether or not the calculated embroidery frame information and the embroidery frame information already stored in the flash memory 24 match. Thus, verification process to determine whether the current embroidery frame 16 in use has been used in the past or not can be made with increased speed.

Next, a description will be given on partial modifications made to the above described embodiment.

1) In S13 of the embroidery frame identification control, the image data of the embroidery frame 16 may be shot upon every instance of moving the image sensor 9 leftward by predetermined distance from the shooting position indicated in FIG. 1 or upon every instance of moving the image sensor 9 longitudinally and identify the three-dimensional form of the embroidery frame 16 based on the plurality of obtained image data.

2) Upon shooting the embroidery frame 16, in case the presence of the needle bar 5, presser foot, and the presser bar considerably prevent obtainment of a complete image of the embroidery frame 16, the outlines may be complemented by referring to embroidery frame information found to have close resemblance among the embroidery frame information already stored in the flash memory 24. Such search for resemblance may be carried out in S14 of the outline extraction process.

3) In case the embroidery frame 16 is too large to be shot in its entirety in a single screen shot by the image sensor 9, the image sensor 9 may employ a wide-angle lens or a zoom mechanism. In such case, the image data may be corrected by a wide-angle correction coefficient of the wide-angle lens or by a zoom correction coefficient calculated from the zoom ratio.

4) The embroidery frame information stored in the flash memory 24 is not limited to the outline data but may be an image data shot as it is in S13 of the embroidery frame identification control or the outline image data calculated in S14 or image data converted to planar outline data calculated in S18. In such case, the calculated image data, the image data already stored in the flash memory 24 may be verified in the verification process of S16 of the embroidery frame identification control.

5) Two image sensors 9 may be mounted in the underside of the arm 3 spaced from the other by a predetermined distance. The three-dimensional form of the embroidery frame 16 may be identified by two image data outputted from the two image sensors 9. Further, three or more image sensors 9 may be provided.

6) A mirror may be provided in the underside of the arm 3 and the image sensor 9 may be mounted on a lower side portion of the pillar 2 so that image data shot by the image sensor 9 may be outputted as planar image data via the mirror. In such case, S18 of the embroidery frame identification control may be eliminated.

7) The outline extraction process (S14) of the embroidery frame 16 may be executed after converting the transparent projected image data shot in S13 of the embroidery frame identification control to planar image data.

8) The foregoing description and drawings are merely illustrative of the principles of the present disclosure and are not to be construed in a limited sense. Various changes and modifications will become apparent to those of ordinary skill in the art. All such changes and modifications are seen to fall within the scope of the disclosure as defined by the appended claims.

What is claimed is:

1. A sewing machine capable of embroidery sewing comprising:

a carriage connected attachably/detachably to an embroidery frame holding a workpiece cloth;

an embroidery frame drive mechanism that drives the carriage independently in an X-direction and a Y-direction perpendicular to each other respectively;

an imaging unit that shoots the embroidery frame and that outputs image data thereof; and a calculating unit that calculates at least an X-directional size, a Y-directional size and a height directional-size of the embroidery frame based on the image data of the embroidery frame.

2. The sewing machine of claim 1, wherein the imaging unit is configured by a charge coupled device (CCD) image sensor or a complementary metal oxide semiconductor (CMOS) image sensor.

3. The sewing machine of claim 1, wherein the imaging unit is disposed in an underside of a sewing machine arm so as to shoot the embroidery frame placed on an upper surface of a sewing machine bed from an obliquely upward direction, and the calculating unit includes an image data converting unit that converts image data outputted from the imaging unit to a planar image data and the X-directional the size, the Y-directional size and the height directional size are calculated based on the image data converted by the image data converting unit.

4. The sewing machine of claim 1, wherein the calculating unit calculates a size of an embroiderable area that is embroiderable by the embroidery frame.

5. The sewing machine of claim 4, further comprising an embroidery frame information storage unit that stores embroidery frame information that includes the image data outputted from the imaging unit; the X-directional size and the Y-directional size and the height-directional size of the embroidery frame; and the size of the embroiderable area calculated by the calculating unit.

6. The sewing machine of claim 5, further comprising an embroidery frame information verification unit that verifies whether or not the embroidery frame information calculated by the calculation unit match the embroidery frame information already stored in the embroidery frame information storage unit.

* * * * *